US005881930A

United States Patent [19]

Lee

[11] Patent Number: 5,881,930

[45] Date of Patent: Mar. 16, 1999

[54] VALVE OF A WATER DISPENSER FOR A REFRIGERATOR

[75] Inventor: Yong-Kweon Lee, Incheon, Rep. of Korea

[73] Assignee: Daewoo Electronics Co., Ltd., Rep. of Korea

[21] Appl. No.: 758,477

[22] Filed: Nov. 29, 1996

[30] Foreign Application Priority Data

Nov. 29, 1995 [KR] Rep. of Korea ..... 1995 44702

[51] Int. Cl.[6] ..... B67D 3/00

[52] U.S. Cl. ..... 222/509; 222/518; 251/262; 251/263

[58] Field of Search ..... 222/505, 509, 222/518, 146.1; 251/229, 263, 262, 321; 141/360, 362

[56] References Cited

U.S. PATENT DOCUMENTS

| | | | |
|---|---|---|---|
| 1,018,924 | 2/1912 | Patnaude | 222/509 |
| 2,039,624 | 5/1936 | Bigelow | 222/509 |
| 4,892,229 | 1/1990 | Rudick | 222/105 |
| 5,303,849 | 4/1994 | Credle, Jr. | 222/129.1 |

FOREIGN PATENT DOCUMENTS

| | | | |
|---|---|---|---|
| 2593600 | 7/1987 | France | 222/509 |

*Primary Examiner*—Andres Kashnikow
*Assistant Examiner*—David Deal
*Attorney, Agent, or Firm*—Pillsbury Madison & Sutro, LLP

[57] ABSTRACT

A valve assembly of a water dispenser for a refrigerator includes a connecting part connected to a reservoir which stores water, a valve spool for opening/closing the connecting part, a biasing spring placed between the connecting part and valve spool, for exerting a biasing force to the valve spool, and an open/close part for raising the valve spool by overcoming the biasing force of the biasing spring. The horizontal motion of a slide member sliding along a base plate swings the cams, and the swing motion of the cams raises the valve spool. Once valve spool ascends, the connecting part is opened and the water within the reservoir is poured into a cup. The valve assembly is easy and convenient to use, is simple in structure, and maximizes the space efficiency of a refrigerating compartment door.

12 Claims, 4 Drawing Sheets

VALVE OF A WATER DISPENSER FOR A REFRIGERATOR

BACKGROUND OF THE INVENTION

1. Field of the Invention

The present invention relates to a water dispenser of a refrigerator, and more particularly to a valve assembly of a water dispenser.

2. Description of the Prior Art

A water dispenser or beverage dispenser is an implement for automatically dispensing drinking water or beverages, which is installed in a house, on office or a public lot for domestic or commercial use. A valve assembly of the water dispenser of a commercially available beverage dispenser employs an actuator which is disclosed in U.S. Pat. No. 5,303,849 issued to Cradle, Jr. on Apr. 19, 1994.

Also, the water dispenser is utilized as a household or office product. In recent years, a beverage dispenser installed in a refrigerator has been suggested. The refrigerator is an appliance for storing a variety of foodstuffs under freezing or refrigerating temperatures in order to main freshness of the foodstuffs for a long time period. The refrigerator is provided with a compartment for storing foodstuffs which is partitioned into a freezer compartment for storing foodstuffs under a freezing temperature and a refrigerating compartment for storing foodstuffs under a refrigerating temperature. The freezer compartment and refrigerating compartment are respectively supplied with cool air generated from an evaporator.

The cool air is directly supplied to the interior of the freezer compartment from the evaporator by means of a fan. Some of the cool air is supplied to the interior of the refrigerating compartment and has its temperature raised while flowing through a duct internally formed in the refrigerator. The freezer compartment and refrigerating compartment are installed with doors at the frontal sides to allow for the act of putting in/taking out the foodstuffs.

In addition, in the refrigerating compartment drinking water is stored. The drinking water is stored within the refrigerating compartment after a container is filled with the drinking water. In order to drink the water stored within the refrigerating compartment, the door is opened to take out the container filled with the drink water. However, the refrigerating efficiency of the refrigerator is lowered by frequently opening he door of the refrigerator.

Recently, in order to solve die above disadvantage, an apparatus for dispensing water of a refrigerator has been proposed, in which the drinking water within the refrigerating compartment can be taken out without opening the door of the refrigerating compartment. FIG. 1 is a section view showing a valve assembly 100 of the water dispenser for the refrigerator, wherein the valve assembly 100 is installed to the front plane of a refrigerating compartment door 10. Here, valve assembly 100 furnished to refrigerating compartment door 10 is formed by a valve body 110 which has an inlet 112 connected to a reservoir (not shown) installed to the inner side of door 10 and has an outlet 114 penetrating through the lower surface thereof. In addition, a valve spool 120 for opening/closing outlet 114, a valve cap 130 for closing the upper portion of valve body 110 and a lever 140 which pivots in order to transfer valve spool 120 up and down, are furnished thereto.

Valve spool 120 includes a rod 124 which is connected to lever 140 by means of a hinge 122 and is moving up and down by the pivoting motion of lever 140, a packing member 126 attached to the lower end of rod 124 for closing outlet 114, and a spring 128 installed between the lower surface of valve cap 130 and packing member 126 for exerting a biasing force upon rod 124. Inlet 112 of valve body 110 is in communicating relation with the inner side of door 10, and is connected to the reservoir placed to the inner side of door 10. The water within the reservoir flows into valve body 110 via inlet 112. Inlet 112 is maintained as being filled with water.

Once the user grips a cup and pushes lever 140 by the cup, lever 140 pivots to raise rod 124 by overcoming the biasing force of spring 128, thereby opening outlet 114. At this time, the water within the reservoir is dispensed and fills up cup 20 under outlet 114.

For sanitary reasons, disposable articles such as a paper cup 20 or a paper-envelope cup, which is used once is generally utilized instead of a plastic cup. Since paper cup 20 has an soft structure, it becomes deformed when lever 140 is pushed by means of paper cup 20. Accordingly, the user must push lever 140 by using the hand gripping paper cup 20. However, in the conventional water dispenser, the water coring out of outlet 114 of valve assembly 100 sometimes lands on the hand of a user, thereby irritating the user. Moreover, in order to connect valve assembly 100 to the reservoir, a wide space of refrigerating compartment door 10 is needed, so the space efficiency of door 10 is lowered. Additionally, after proper time passing, a deposit stacks in inlet 112 of valve body 110, then the deposit causes dirtiness of the water dispenser.

SUMMARY OF THE INVENTION

Therefore, it is an object of the present invention to provide a valve assembly of a water dispenser for a refrigerator capable of being clear, conveniently used and of increasing the space efficient of a refrigerating compartment door of a refrigerator.

To achieve the above object of the present invention, a valve assembly of a water dispenser for a refrigerator includes a connecting part having a cap for being screw-coupled to a reservoir which is installed to the inner side of a refrigerating compartment door and stores water, an outlet conduit longitudinally formed by piercing through the center of the cap for allowing the water within the reservoir to flow, and a guide member formed to the inner side of the upper portion of the outlet conduit and having a guide hole in the center thereof. In addition, a valve spool joined to the outlet conduit of the connecting part has a packing member for opening/closing the outlet conduit, and a biasing member is placed between the connecting part and valve spool, for exerting a biasing force to the valve part. Also, an open/close part has a base plate fixed to the refrigerating compartment door, a slide member slidably mounted to the base plate, and a pair of cams pivoting by means of the slide member for moving the valve spool up and down.

Preferably, the connecting part has a guide conduit which is longitudinally formed is to the lower surface of the cap, is formed to the outer side of the outlet conduit and forms a concentric circle together with the outlet conduit. A screw thread is provided to the inner periphery of the cap, and a guide hole is formed in the inner center of the outlet conduit. Here, the cap, the outlet conduit, the guide conduit and the guide member are integrally formed.

It is preferable that the valve spool further includes a valve rod attached to the packing member at the upper end thereof for moving the packing member up and down, and a valve cock which the outlet conduit is inserted into and to which the lower end of the valve rod is fixed.

More preferably, the valve cock has a first cylinder which the outlet conduit is inserted, a second cylinder having a diameter larger da that of the first cylinder, a shoulder for connecting one side of the first cylinder to one side of the second cylinder, and a fixing rib formed within the first cylinder in the radial direction which the valve rod is fixed to the center of the fixing rib.

Furthermore, the open/close part includes a pair of ribs having hinges to which the pair of cams is pivotally mounted, stop projections projecting from one sides the ribs for obstructing the pivoting motion of the cams, ad a pair of coil springs for returning the pair of cams to the original position wherein the pair of hinges is inserted into the springs. In addition to these, a push plate for sliding the slide member by applying a pressure, an operation rod projected from the front surface of the slide member for transmitting die pressure of the push plate to the slide member, and a return spring for returning the push plate to the original position, which the operation rod is inserted into the return spring are provided in Me open/close part. Preferably, a pair of rails to which the slide number is slidably mounted is formed to the inner side of the base plate, and the slide member is formed with an longitudinal hole for permitting the water issued via the outlet conduit to pass therethrough when the outlet conduit is opened.

When a user applies the pressure to the push plate, the slide member slides. By the sliding motion of the slide member, the pair of cams pivots and raises the valve spool. At this time, the packing member opens the upper end of the outlet conduit by means of the valve rod of the valve spool, so the water within the reservoir is issued.

The valve assembly of the water dispenser for the refrigerator according to the present invention is simple in structure, is able to maintain cleanliness, is convenient to use, and increases the space efficiency of the refrigerating compartment door.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENT

A preferred embodiment of a valve assembly of a water dispenser for a refrigerator according to the present invention will be described in detail with reference to accompanying drawings.

Figure 1:
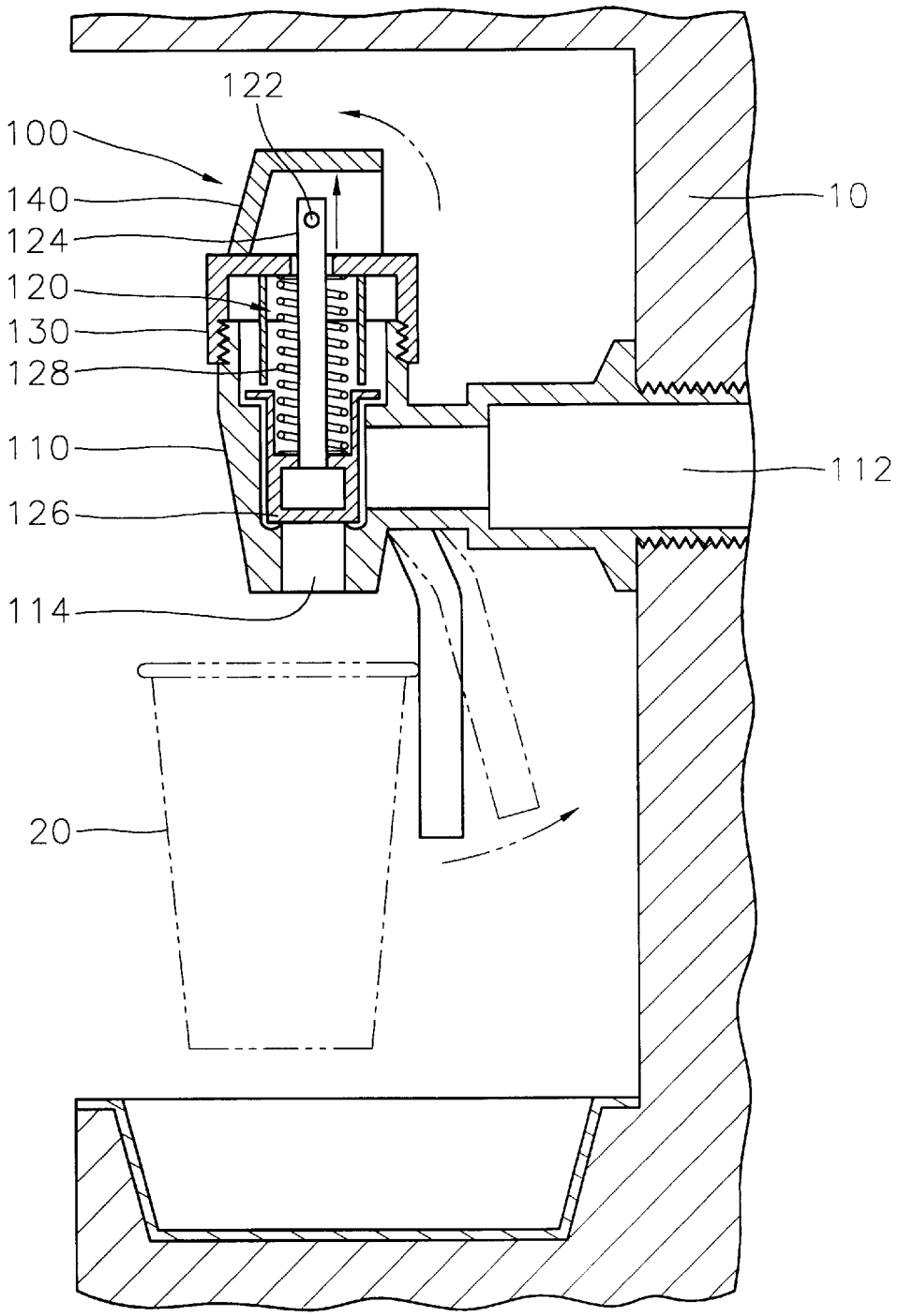
FIG. 1 (PRIOR ART)
FIG. 1 is a sectional view showing a valve assembly of a water dispenser for a conventional refrigerator.
Figure 2:
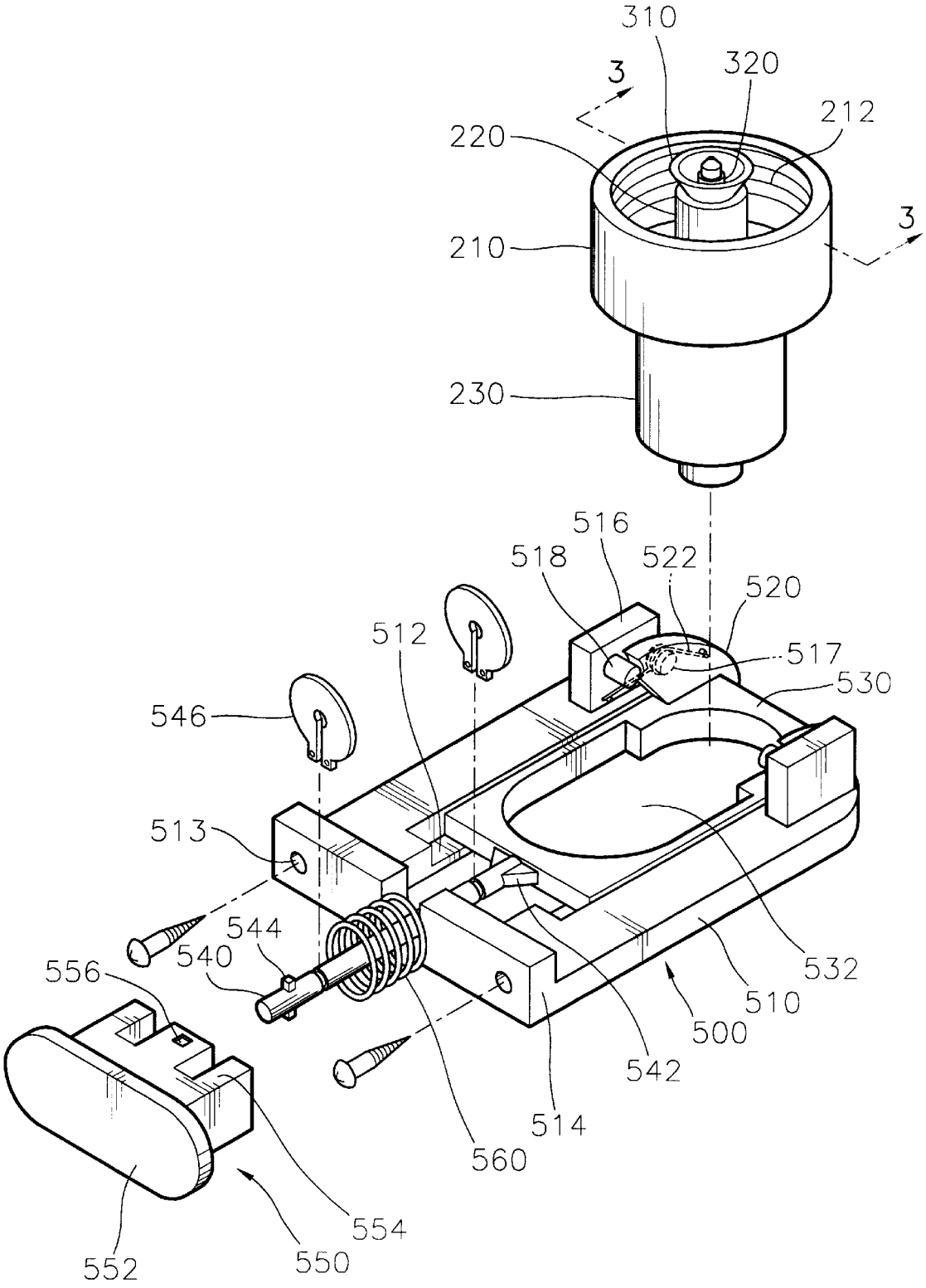
FIG. 2 is an exploded perspective view showing a valve assembly of a water dispenser for a refrigerator according to the present invention.
Figure 3:
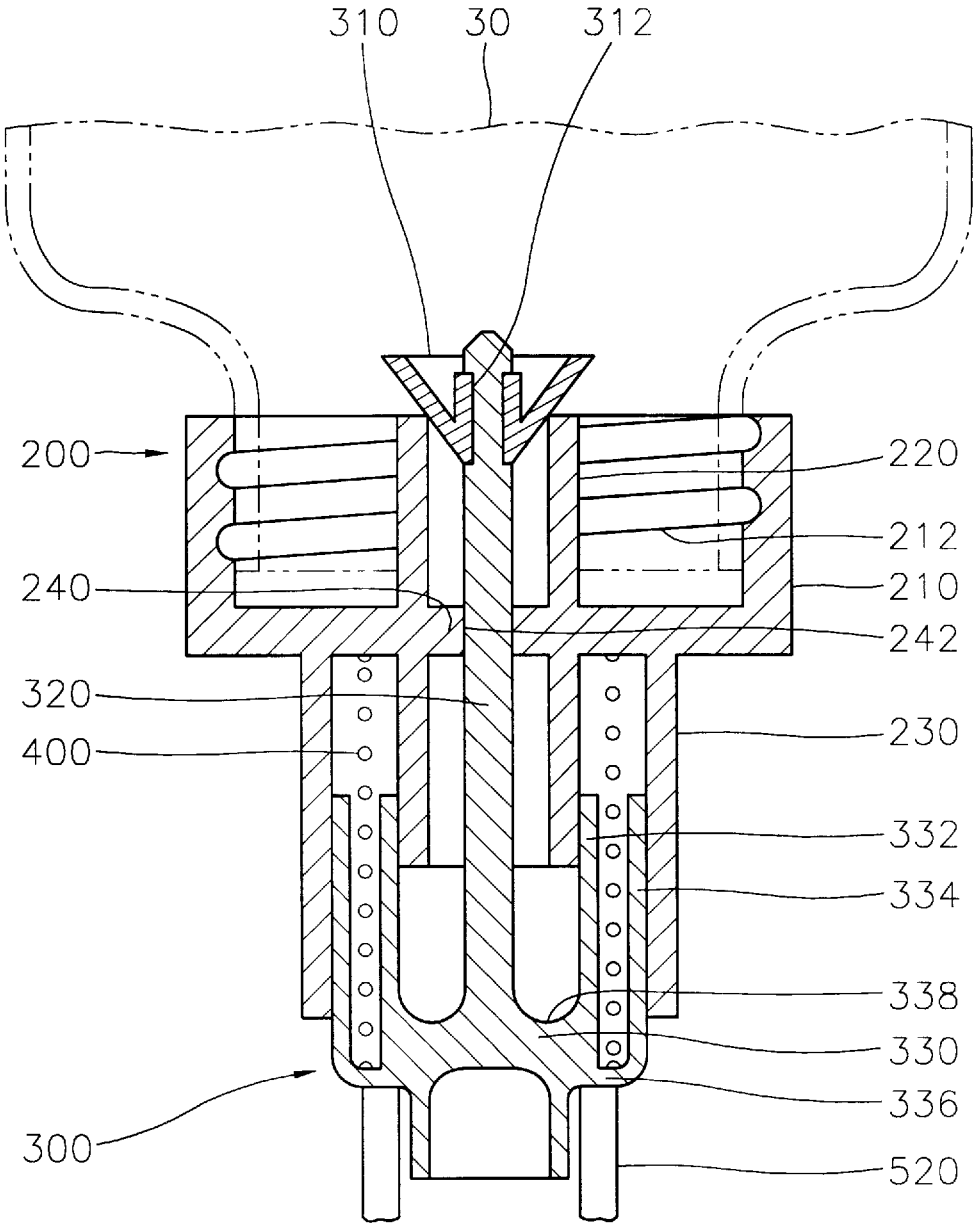
FIG. 3 is a sectional view taken along line 3—3 in FIG. 2.

FIG. 2 is an exploded perspective view showing the valve assembly of the water dispenser for the refrigerator according to the present invention. FIG. 3 is a sectional view taken along line 3—3 in FIG. 2. Referring to FIGS. 2 and 3, the valve assembly of the water dispenser for the refrigerator according to the present invention includes a connecting part 200 installed to the inner side of a refrigerating chamber door and being connected to a reservoir 30 for storing water, and to a valve spool 300 for opening/closing connecting pan 200. Also, a biasing spring 400 which is disposed between connecting part 200 and valve spool 300 exerts a biasing force upon valve spool 300, and an open/close part 500 operates valve spool 300.

Connecting part 200 is formed by a cap 210 screw-coupled to the entrance of reservoir 30, an outlet conduit 220 longitudinally formed at the center of cap 210, and a guide conduit 230 which is formed to the outer side of outlet conduit 220 and is concentric with outlet conduit 220. Additionally, a guide member 240 is formed with a guide hole 242 at the inner center of the upper portion of outlet conduit 220.

A screw thread is provided to an inner periphery 212 of cap 210, so cap 210 is coupled to reservoir 30 by the screw thread. Outlet conduit 220 is formed to be concentric with cap 210, for piercing through cap 210. Guide conduit 230 extends from the lower surface of cap 210, has a diameter greater than outlet conduit 220, and is longer than outlet conduit 220. Guide member 240 is wheel shaped, is formed at the inner upper side of outlet conduit 220, and is formed with guide hole 242 therein. Cap 210, outlet conduit 220, guide conduit 230 and guide member 240 are integrally formed as one body.

Valve spool 300 for opening/closing connecting part 200 is furnished to the interior of connecting part 200. Valve spool 300 has a packing member 310 for opening/closing one side of outlet conduit 220, a valve rod 320 to which packing member 310 is attached at the upper end of valve rod 320 for moving packing member 310 up and down, and a valve cock 330 interposed between guide conduit 230 and outlet conduit 220 which the lower end of valve rod 320 is fixed to.

Packing member 310 is conically-shaped and is fabricated by a substance such as silicon or rubber. A coupling hole 312 is formed in the center of packing member 310. The upper end of valve rod 320 is inserted into coupling hole 312 of packing member 310 and combines with packing member 310. Packing member 310 opens/closes outlet conduit 220 by the up and down movement of valve rod 320 under the state of being coupled with valve rod 320. Valve rod 320 is fixed to valve cock 330. Here, valve cock 330 is provided with a first cylinder 332 and a second cylinder 334, in which one side of first cylinder 332 and one side of second cylinder 334 are connected to each other by a shoulder 336. A fixing rib 338, for fixing valve rod 320, is formed in the interior of first cylinder 332 in the radial direction, and the center thereof is fixed with the lower end of valve rod 320. First and second cylinders 332 and 334 are interposed between outlet conduit 220 and guide conduit 230.

Biasing spring 400 is installed in a space defined by cap 210, outlet conduit 220, guide conduit 230 and valve cock 330, and exerts a downward force (biasing force) on valve cock 330.

Open/close part 500, for operating valve spool 300, includes a base plate 510 and a pair of cams 520 which are mounted to both ends of one side of base plate 510 in such a way that they are able to pivot. Additionally, a slide member 530 is slidably mounted to the inner side of base plate 510 in order to pivot pair of cams 520, and an operation rod 540 is projected from the front surface of slide member 530. A push plate 550 is coupled to operation rod 540 and applies a pressure to slide member 530 to slide member 530, and a return spring 560 which operation rod 540 is inserted into returns push plate 550 to its original position.

Base plate 510 is provided with a pair of rails 512 which are inwardly extended and slide member 520 are slidably mounted on a fixing plate 514 formed to the front surface of base plate 510 for fixing base plate 510 to refrigerating compartment door 10, and a pair or ribs 516 installed to both ends of one side of base plate 510 and formed with a hinges 517 and detent projections 518 at its inner sides. Screw holes 513 are formed in both sides of fixing plate 514, which are fitted with screws.

Pair of cams 520 are pivotally mounted to pair of ribs 516 by pair of hinges 517 of pair of ribs 516. Pair of hinges 517 is inserted into pair of coil springs 522. Pair of coil springs 522 exerts an elastic force to impel pair of cams 520 to its original position. When slide member 530 slides, pair of cams 520 pivots and one side thereof are confined by detent projections 528. At this time, valve spool 300 does not ascend further. Pair of cams 530 pivots by slide member 530 to a predetermined angle and returned to its original positions by pair of coil springs 522. Slide member 530 is formed with an longitudinal hole 532 for permitting water which has flowed through outlet conduit 220 to pass therethrough.

Meantime, operation rod 540 projects from the front surface of slide member 530. One end of operation rod 540 is fixed to slide member 530 by a connection rib 542, and projects by piercing through fixing plate 514. Also, a connection lug 544 connected to push plate 550 is formed at the other end of operation rod 540. Return spring 560 receives operation rod 540, and a pair of detent rings 546 is fixed to both sides of operation rod 540. Return spring 560 does not deviate from operation rod 540 because of pair of detent rings 546.

Push plate 550 is provided with a push plane 552 pushed by a user, and with a connecting member 554 extending from push plane 552 and being coupled with operation rod 540. Operation rod 540 is joined to connecting member 554 by inserting connection lug 544 into a connection hole 556 formed in the interior of connecting member 554. Push plane 552 and connecting member 554 are integrally formed with each other.

Hereinbelow, an operation of the valve assembly of the water dispenser for the refrigerator according to the preferred embodiment of the present invention will be described.

Figure 4:
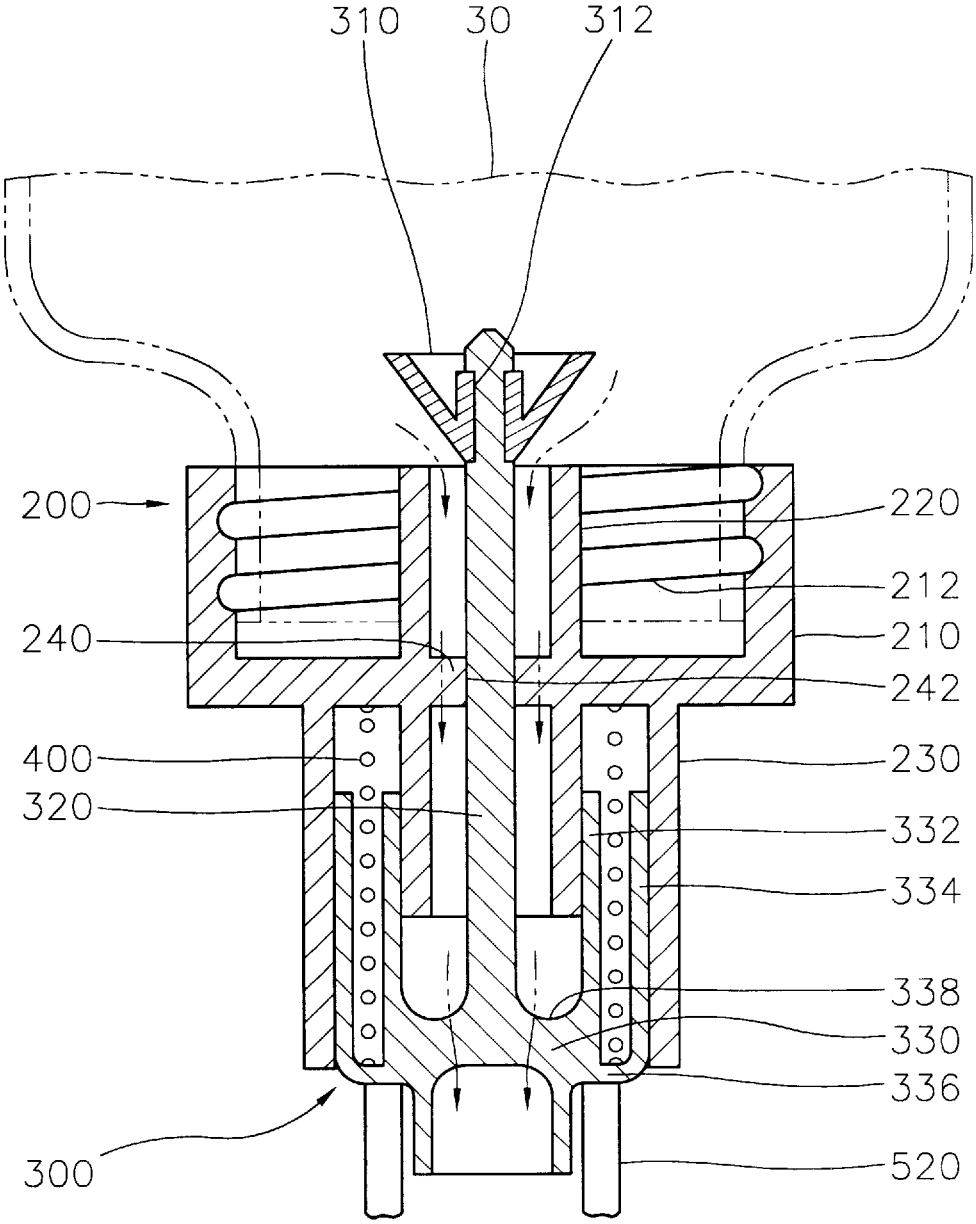
FIG. 4 is a sectional view for illustrating an operation of the valve assembly shown in FIG. 2.

First, referring to FIG. 4, under the state where connecting part 200, valve spool 300 and biasing spring 400 are coupled with one another, and cap 210 of connecting part 200 is coupled to reservoir 30 which stores the water therein, reservoir 30 is turned upside down. At this time, shoulder 332 of valve cock 330 of open/close part 500 comes in contact with pair of cams 520.

In order to drink the cool water stored within the refrigerator, the user pushes push plate 550. At this time, push plate 550 slides slide member 530 and pivots pair of cams 520 to the predetermined angle by overcoming the biasing force of return spring 560. At this time, valve cock 330, which is in contact with pair of cams 520 ascends by overcoming the biasing force of biasing spring 400. Consequently, outlet conduit 220 fixed to valve rod 320 opened, and the water within reservoir 30 drops into cup 20 underneath base plate 510 via outlet conduit 220 and longitudinal hole 532.

When the user stops pushing push plate 550, push plate 550 is returned to the original position by return spring 560, and pair of cams 520 pivots due to the biasing force of biasing spring 400, and pair of coil springs 522, and return to its original position. At this time, slide member 530 slides along pair of rails 512 and return to its original position, and outlet conduit 220 is closed by packing member 310.

As described above, the valve assembly of the water dispenser for the refrigerator according to the present invention is effective in that it is easy and convenient to maintain cleanliness and use. Also, the valve assembly is simple in structure, and the user is capable of maximizing the space efficiency of the refrigerator door. Furthermore, the cup is not deformed even though it is produced from an soft material, and the user does not wet his hand with water.

While the present invention has been particularly shown and described with reference to particular embodiment thereof, it will be understood by those skilled in the art that various changes in form and detail may be effected therein without departing from the spirit and scope of the invention as defined by the appended claims.

What is claimed is:

1. A valve assembly of a water dispenser for a refrigerator comprising:

connecting means having a cap installed to an inner side of a refrigerating compartment door for being screw-coupled to a reservoir in which water is stored, an outlet conduit longitudinally formed by piercing through the center of said cap, for allowing said water within said reservoir to flow, and a guide member formed to the inner side of the upper portion of said outlet conduit and having a guide hole in a center thereof;

valve means joined to said outlet conduit of said connecting means, said valve means having a packing member for opening/closing said outlet conduit;

a biasing member placed between said connecting means and said valve means, for exerting a biasing force upon said valve means; and open/close means having a base plate fixed to said refrigerating compartment door, a slide member slidably mounted to said base plate, and a pair of cams swinging by means of said slide member, said cams being for moving said valve means up and down.

2. A valve assembly of a water dispenser for a refrigerator as claimed in claim 1, wherein said connecting means further comprises a guide conduit longitudinally formed to the lower surface of said cap, formed to the outer side of said outlet conduit, and forming a concentric circle together with said outlet conduit; and a screw thread is provided at the inner periphery of said cap, a guide hole is formed in the inner center of said outlet conduit, and said cap, outlet conduit, guide conduit and guide member are integrally formed.

3. A valve assembly of a water dispenser for a refrigerator as claimed in claim 1, wherein said valve means further comprises:

a valve rod for moving said packing member up and down, said packing member being attached to an upper end of said valve rod; and a valve cock for fixing a lower end of said valve rod to said outlet conduit, said outlet conduit being inserted into said valve cock.

4. A valve assembly of a water dispenser for a refrigerator as claimed in claim 3, wherein said valve cock further comprises:

a first cylinder, into which said outlet conduit is inserted;

a second cylinder having a diameter larger than that of said first cylinder;

a shoulder for connecting one side of said first cylinder to one side of said second cylinder; and a fixing rib formed in a radial direction within said first cylinder, said valve rod being fixed to a center of said fixing rib.

5. A valve assembly of a water dispenser for a refrigerator as claimed in claim 1, wherein said open/close means comprises:

a pair of ribs having hinges which are installed to both ends of one side of said base plate and are formed toward the inner side, and being pivotally mounted to said cams, having stop projections projecting from one sides for confining the swinging motion of said cams, and having a pair of coil springs, into which said hinges are inserted for returning said cams to original positions thereof;

a push plate for sliding said slide member by applying a pressure; and an operation rod projecting from the front surface of said slide member, for transmitting said pressure of said push plate to said slide member, whereby a pair of rails on which said slide member are slidably mounted is formed to the inner side of said base plate, and said slide member is formed with an orifice for permitting said water issued via said outlet conduit to pass therethrough when said outlet conduit is opened.

6. A valve assembly of a water dispenser for a refrigerator as claimed in claim 5, wherein said open/close means comprises:

a return spring, into which said operation rod is inserted, for returning said push plate to an original position thereof; and a pair of stop rings fixed to the outer periphery of said operation rod, for confining both ends of said return spring to prevent said return spring from being separated from said operation rod.

7. A valve assembly of a water dispenser for a refrigerator comprising:

connecting means having a cap installed to the inner side of a refrigerating compartment door for being screw-coupled to a reservoir which stores water, an outlet conduit longitudinally formed by piercing, through the center of said cap, for allowing said water within said reservoir to flow, a guide member formed to the inner side of the upper portion of said outlet conduit and having a guide hole in the center thereof, and a guide conduit longitudinally formed to the lower surface of said cap, formed to the outer side of said outlet conduit, and forming a concentric circle together with said outlet conduit;

valve means joined to said outlet conduit of said connecting means and having a packing member for opening/closing said outlet conduit, said valve means having a valve rod for moving said packing member up and down wherein said packing member is attached to an upper end of said valve rod, and a valve cock for fixing a lower end of said valve rod to said outlet conduit, said outlet conduit being inserted into said valve cock;

a biasing member placed in a space defined by said cap, said outlet conduit, and said valve cock, for exerting a biasing force to said valve means; and open/close means having a base plate fixed to said refrigerating compartment door, a slide member slidably mounted to said base plate, a pair of cams swinging by means of said slide member, for moving said valve means up and down, a pair of ribs installed to both ends of one side of said base plate, for being slidably mounted with said cams, a push plate, for sliding said slide member by applying a pressure, an operation rod projecting from the front surface of said slide member, for transmitting said pressure of said push plate to said slide member, and a return spring, into which said operation rod is inserted, for returning said push plate to an original position thereof.

8. A valve assembly of a water dispenser for a refrigerator as claimed in claim 7, wherein said cap, outlet conduit, guide conduit and guide member are integrally formed.

9. A valve assembly of a water dispenser for a refrigerator as claimed in claim 7, wherein a pair of rails on which said slide member are slidably mounted is formed to the inner side of said base plate, and said slide member is formed with an orifice for permitting said water issued via said outlet conduit to pass therethrough when said outlet conduit is opened.

10. A valve assembly of a water dispenser for a refrigerator as claimed in claim 7, wherein said valve means further comprises:

a first cylinder, into which said outlet conduit is inserted;

a second cylinder having a diameter larger than that of said first cylinder;

a shoulder for connecting one side of said first cylinder to one side of said second cylinder; and a fixing rib formed in a radial direction within said first cylinder, said valve rod being fixed to a center of said fixing rib.

11. A valve assembly of a water dispenser for a refrigerator as claimed in claim 7, wherein said open/close means further comprises a pair of stop rings fixed to the outer periphery of said operation rod, for confining both ends of said return spring to prevent said return spring from being separated from said operation rod.

12. A valve assembly of a water dispenser for a refrigerator comprising:

connecting means having a cap installed to an inner side of a refrigerating compartment door for being screw-coupled to a reservoir which stores water, an outlet conduit longitudinally formed by piercing through a center of said cap, for allowing said water within said reservoir to flow, a guide member being formed to the inner side of the upper portion of said outlet conduit and having a guide hole in the center thereof, and a guide conduit being longitudinally formed to the lower surface of said cap, being formed to the outer side of said outlet conduit, and forming a concentric circle together with said outlet conduit, wherein said cap, outlet conduit, guide conduit and guide member are integrally formed;

valve means joined to said outlet conduit of said connecting means and having a packing member for opening/closing said outlet conduit, said valve means having a valve rod for moving said packing member up and down wherein said packing member is attached to an upper end of said valve rod, and a valve cock for fixing a lower end of said valve rod to said outlet conduit, said outlet conduit being inserted into said valve cock, said valve cock having a first cylinder, into which said outlet conduit is inserted, a second cylinder having a diameter larger than that of said first cylinder, a shoulder for connecting one side of said first cylinder to one side of said second cylinder, and a fixing rib formed in a radial direction within said first cylinder, said valve rod being fixed to a center of said fixing rib;

a biasing spring placed in a space defined by said cap, said outlet conduit, and said valve cock, for exerting a biasing force to said valve means; and open/close means having a base plate fixed to said refrigerating compartment door, a slide member slidably mounted to said base plate, a pair of cams swinging by means of said slide member, for moving said valve means up and down, a pair of ribs installed to both ends of one side of said base plate, for being slidably mounted with said cams, a push plate, for sliding said slide member by applying a pressure, an operation rod projecting from the front surface of said slide member, for transmitting said pressure of said push plate to said slide member, a return spring, into which said operation rod is inserted, for returning said push plate to an original position thereof, and a pair of stop rings fixed to the outer periphery of said operation rod, for confining both ends of said return spring to prevent said return spring from being separated form said operation rod.

* * * * *